United States Patent [19]

York

[11] Patent Number: 4,653,738

[45] Date of Patent: Mar. 31, 1987

[54] FLETCHING TOOL

[76] Inventor: Merineth S. York, 639 S. Elm St., Mesa, Ariz. 85202

[21] Appl. No.: 809,589

[22] Filed: Dec. 13, 1985

[51] Int. Cl.[4] ..... B25B 1/20

[52] U.S. Cl. ..... 269/38

[58] Field of Search ..... 269/38, 274

[56] References Cited

U.S. PATENT DOCUMENTS

| | | | |
|---|---|---|---|
| 1,648,376 | 11/1927 | Blodgett | 269/38 X |
| 1,945,416 | 1/1934 | Birchall | 269/38 X |
| 2,742,064 | 4/1956 | Quist | 269/274 X |
| 2,983,293 | 5/1961 | Murray | 269/38 X |
| 3,027,156 | 3/1962 | Schnoor | 269/38 |
| 3,322,421 | 5/1967 | Sisty | 269/38 |

FOREIGN PATENT DOCUMENTS

| | | | |
|---|---|---|---|
| 716023 | 9/1954 | United Kingdom | 269/38 |
| 776841 | 6/1957 | United Kingdom | 269/38 |

*Primary Examiner*—Frederick R. Schmidt
*Assistant Examiner*—Steven P. Schad
*Attorney, Agent, or Firm*—Robert A. Hirschfeld

[57] ABSTRACT

A fletching tool holds fletching in individually splayable fletching guides, precisely locating an arrow shaft in spaced relation to the fletching, while adhesive between fletching and shaft dries. Anti-stick surfaces resist excess glue upon the tool. Provision is made to adjust the distance and angular orientation of the arrow nock to the fletching. The tool is useful for field replacement of damaged fletching as well as making of new arrows.

11 Claims, 9 Drawing Figures

FLETCHING TOOL

BACKGROUND OF THE INVENTION

1. Technical Field

The invention relates to tools for the making and repair of arrows.

In particular, the invention relates to a tool for facilitating the precise gluing of pre-molded fletching to an arrow shaft, the tool being particularly handy for field repair of arrows.

2. Prior Art

Modern hunting and sport archery employs arrows having 16 pre-molded fletching, or simulated feathers, which are commonly glued the the exterior of the arrow shaft, instead of the more laborious insertion of feathers or other fletching into grooves dating back to the ancient "fletcher's" art. (The word derives from the French "fleche" for arrow.)

An existing fletching tool is heavy and cumbersome, being more suitable to workbench mounting, and provides for clamping of a single fletch at a time in relationship to a clamped arrow shaft while the applied glue dries. Modern 3-fletch or 4-fletch arrows therefore require a sequential gluing operation using existing apparatus.

The typical fletch has a portion extending radially from the arrow shaft, joined near said shaft with a t-shaped portion which is tangentially or coaxially glued to the shaft.

Hunters and sportsmen in the field may attempt to reglue a fletch torn off in flight or otherwise damaged on a retrieved arrow shaft, but if this is done using only visual alignment, the resultant fletching may cause the arrow to subsequently suffer from asymmetrical, deviant or unpredictable aerodynamic behavior, thereby impairing target accuracy. It is desirable that fletching be accurately attached to the arrow shaft in order to achieve reproducible archery performance.

It is further desirable that fletching be attached in precise angular relationship to the direction of the arrow nock, in which the bowstring is to be placed.

It is often desired to install or replace fletching on a number of arrows, particularly in the field during hunting expeditions or archery competitions where rapid arrow reuse is advantageous. The use of a single, expensive fletching tool capable of attaching single fletching only as fast as the glue-drying cycle allows, can cause considerable delay in such a situation. It is desirable to glue and dry all fletching simulataneously. Such operation would be enhanced if the fletching tool were simple enough to be economically manufactured, so that an archer could afford several such tools for simultaneous drying of several arrows in the field.

Once an arrow held within a fletching tool is dry, excess glue may still stick to the tool, requiring cleaning of the tool between repair cycles. Such excess glue can also inhibit removal of the dried arrow from a prior-art fletching tool in which axial withdrawal of the arrow and fletching from the fletching-clamping portion of the tool is required.

Therefore, it is an object of the invention to provide a fletching tool capable of simultaneous attachment of more than one fletching at a time to the arrow shaft.

Another object of the invention is to provide a fletching tool capable of precise relative spatial location of a plurality of fletching to the desired locus on the arrow shaft, and in relation to the arrow nock.

A further object of the invention is to provide a fletching tool which is simple, lightweight and inexpensive, for maximum convinience in field use.

Still another object of the invention is to provide a fletching tool in which the fletching-guide or clamping elements may be withdrawn from contact with the fletching prior to withdrawal of the arrow from the tool.

A still further object of the invention is to provide a fletching tool resistant to sticking of excess glue.

Another object of the invention is to provide a fletching tool in which access may be obtained readily to the glue-attachment surface of the fletching after emplacement of the arrow shaft and the fletching in the tool.

Yet another object of the invention is to provide a fletching tool adaptable to varying dimensional relationships between arrow shaft, nock and fletching, as well as variations in angular relationship between nock and fletching, and various shaft diameters, nock sizes and fletching sizes.

DISCLOSURE OF THE INVENTION

A spool with a central bore is in use passed over an arrow shaft. A C-shaped wire ring captive to the spool engages the arrow nock, fixing the relative angular position of the nock to the tool. A plurality of fletching guides are coupled flexibly or by hinges to the spool. Each fletching guide has a longitudinal groove or slot into which the fletching may be inserted, while the fletching guide is splayed outward from the spool, and easily accessible. Because each fletching guide is individually splayable, the tool may be applied to an arrow shaft on which only one fletching is to be replaced, the others remaining from prior attachment, or any number up to the full number of fletchings may be simultaneously attached. Glue may be applied to the attachment edges or T-shaped glue surfaces of the fletching after the fletching is already inserted into the respective groove, whereupon the splayed fletching guides are closed inwardly upon the arrow shaft, each representing a segment of a cylindrical annulus about the shaft, the closed structure comprising a torsionally rigid cylindrical annulus or sleeve through grooves of which the fletching protrudes. A collar pressed or screwed down upon the closed structure holds the glue-laden fletching surfaces in intimate contact with the arrow shaft until the glue dries. Disengagement of the collar then permits the fletching guides to be splayed away from the shaft, which then complete is withdrawn from the tool.

Various C-shaped wire ring sizes and orientations with respect to the spool provide selectability in length, nock size, and angular relationship of the fletching to the nock.

In another embodiment, the longitudinal grooves are helically disposed, for precise attachment of spiral fletching as somethimes used to induce arrow spin in flight.

The surfaces of the fletching guides likely to come in contact with excess glue are coated with a glue-resistant, anti-sticking material such as the synthetic resin polymer marketed under the trade mark TEFLON.

BEST MODE FOR CARRYING OUT THE INVENTION

Figure 1:
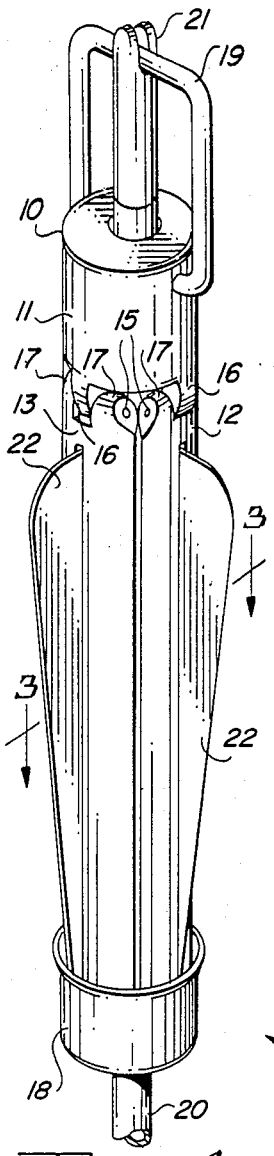
FIG. 1 is a perspective view of an arrow shaft and fletching held in closed position in the fletching tool.

For the purpose of promoting an understanding of the principles of the invention, reference will now be made to the embodiments illustrated in the drawings. Specific language will be used to describe the same. It will, nevertheless, be understood that no limitation of the scope of the invention is thereby intended, such alterations and further modifications in the illustrated device; and such further applications of the principles of the invention as illustrated herein being contemplated as would normally occur to one skilled in the art to which the invention relates.

FIG. 1 illustrates in perspective view the fletching tool generally referred to as 10 in closed position, containing an arrow shaft workpiece 20 and fletching workpieces 22. Spool 11 has a bore 23 (indicated in FIG. 5) through which arrow shaft 20 is inserted until nock 21 engages C-shpaed wire ring 19, which is pivotingly captive in spool 11 as more clearly seen in FIG. 5.

Fletching guides 12,13 and 14 (Seen in FIGS. 2,3) are hingedly coupled to spool 11 by hinge pins 15 through spool hinge members 16 cooperating with fletching guide hinge members 17. In the closed position or condition of FIG. 1, collar 18 compresses guides 12,13,14 against fletching attachment surface 27 (seen in FIG. 4), pressing same against the fletching attachment locus (not separately indicated) of arrow shaft 20, allowing glue (not separately indicated) applied between fletching attachment surface 27 and the arrow shaft 20 to dry. As will be readily understood by one skilled in the art, the closed cylindrical annulus shown in FIG. 1 inherently provides torsional rigidity between the spool 11 and the portion of fletching tool 10 adjacent collar 18, thereby assuring that in the illustrated closed condition, fletching 22 is accurately disposed in the desired spatial relationship to arrow shaft 20.

Figure 2:
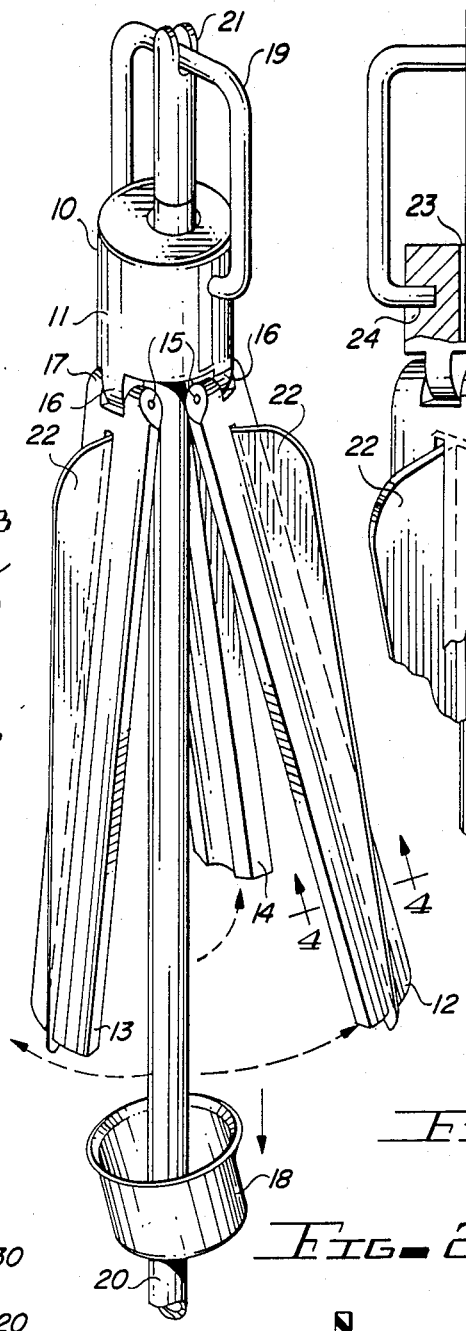
FIG. 2 is a view similar to that of FIG. 1, in which the fletching guides are shown in splayed, open position holding the fletching prior to gluing to the arrow shaft.

FIG. 2 illustrates in perspective view the fletching tool 10 in open position or condition prior to affixation of glued surfaces 27 to shaft 20. It may be seen that the pre-molded fletching may easily be inserted into respective grooves 26 (seen in FIG. 6) in said open position, and that the hinges comprised of 15,16,17 permit accurate emplacement of fletching 22 for gluing to shaft 20 when closed from the open condition of FIG. 2 to the condition of FIG. 1.

Figure 9:
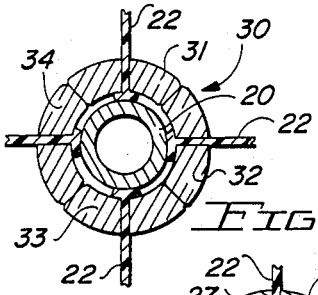
FIG. 9 is a view similar to FIG. 3, illustrating a four-fletching embodiment.
Figure 3:
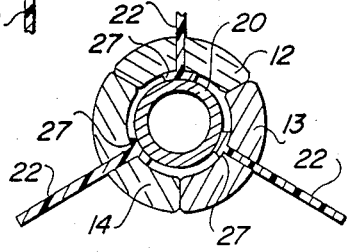
FIG. 3 is a view of section 3—3 of FIG. 1 in cross-section.

FIG. 3 illustrates in cross-section 3—3 of FIG. 1 the manner in which sectors of cylindrical annulae, fletching guides 12,13,14, press fletching attachment surfaces 27 against shaft 20, forming in combination a cylindrical annulus. FIG. 9 illustrates the same principle applied to four-fletch embodiment 30, having fletching guides 31,32,33,34.

Figure 4:
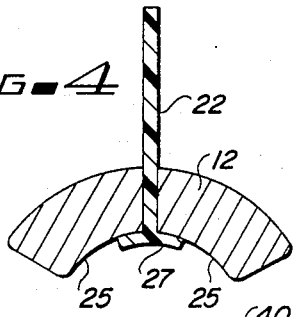
FIG. 4 is a view of section 4—4 of FIG. 2 in cross-section.

FIG. 4 shows in greater detail the cross-section of fletching guide 12 and fletching 22 having fletching attachment surface 27, as is seen in FIG. 3. A coating of synthetic resin polymer such as that sold under the trademark TEFLON is applied at surfaces 25 to prevent excess glue or adhesive from sticking to fletching guide 12.

Figure 5:
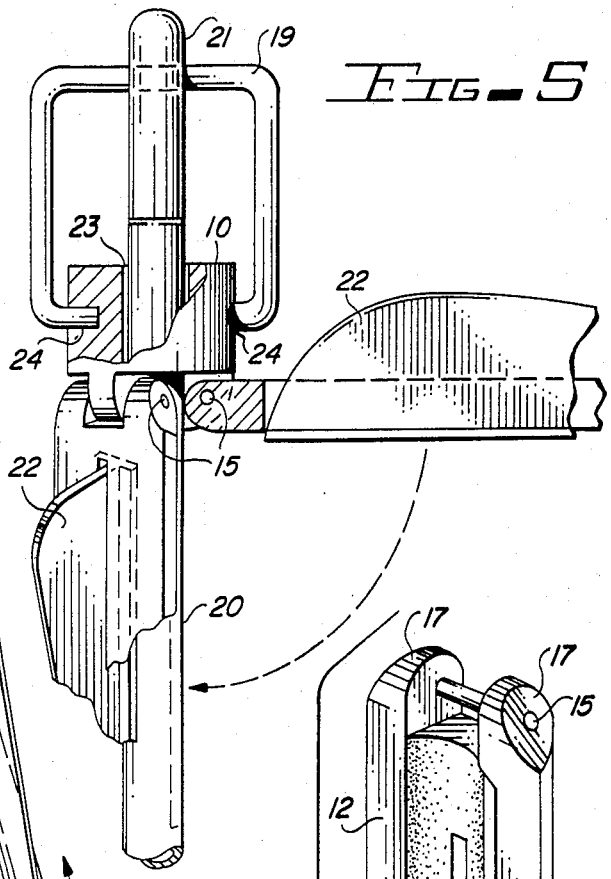
FIG. 5 is a side partial cutaway view of the invention.

FIG. 5 shows in partial cutaway view fletching 22, the manner in which hinging is accomplished about pins 15, and the manner in which ends 24 of C-shaped wire ring 19 ends 24 cooperate pivotingly in holes (not separately indicated) in spool 10. Shaft 20 slidingly penetrates hole 23.

Figure 6:
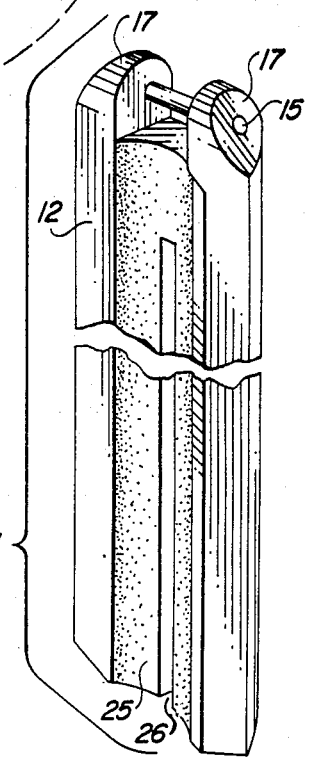
FIG. 6 is a detail perspective view from the interior of one of the fletching guides.

FIG. 6 illustrates in greater detail fletching guide 12 with hinge members 17, pin 15, groove or slot 26, and non-stick surface 25.

Figure 7:
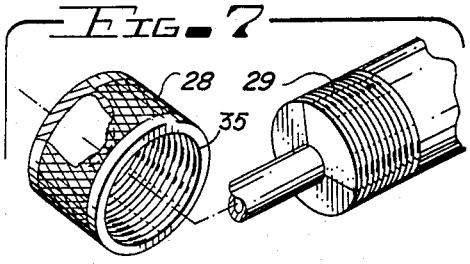
FIG. 7 is a cutaway perspective view of a portion of an alternative embodiment of the collar shown in FIGS. 1,2, showing cooperating threads.

In FIG. 7, an alternative embodiment is shown wherein threaded cap 28 is substituted for press-fit collar 18 of the previous figures. Interior threads 35 cooperate with threads 29 of the closed-position fletching guides.

Figure 8:
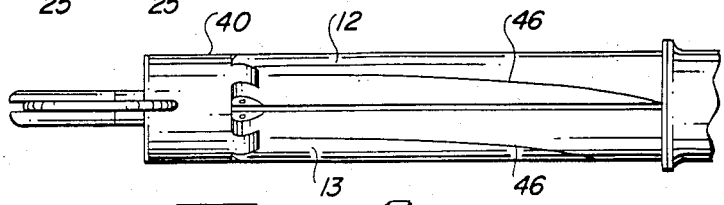
FIG. 8 is a side view of an alternative embodiment to the views of FIGS. 1,2,5,6 showing helical grooves in the fletching guides suitable for spiral fletching.

FIG. 8 illustrates helical grooves 46 in an alternative embodiment 40, spirally disposing the fletching when spinning aerodynamic arrow flight is desired.

Although hinges are illustrated, the invention also contemPlates the unitary formation of spool 11 with fletching guides 12,13,14 from flexible material, wherein the splaying shown in FIGS. 2,5 may be accomplished by flexure rather than hinges.

It is also contemplated that a variety of C-shaped wire ring 19 lengths may be selected to accommodate nocks of various sizes and distances from the desired emplacement loci of the fletching 22. Ordinarily in 3-fletching arrows, one of the fletchings, such as that shown in FIG. 2 as 22 in fletching guide 13, is radially disposed orthogonal to the direction defined by nock 21, to facilitate bowstring engagement during archery. However, it is contemplated that some variation in such relative angular relationship between fletching 22 and nock 21 may be, as a matter of individual archer choice, desired. It is contemplated, and will be understood by one skilled in the art, that the cooperating holes (not separately indicated ) in spool 11 which capture the ends 24 of C-shaped wire ring 19, may be placed at various angular positions in spool 24 to vary said angular relationship.

The invention is used as follows:

An arrow shaft 20, having nock 21, with or without already attached fletching 22 is inserted through collar 18 as shown in FIG. 2 through spool 11, into engagement with C-shaped wire ring 19, while fletching guides 12,13,14 are outwardly splayed. If repair is being accomplished, the damaged or defective fletching is stripped off while good fletching may remain upon shaft 20. The new or replacement fletching 22 is slid or emplaced into slots 26 where required. Glue or adhesive is carefully applied to surfaces 27 of fletching 22. Fletching guides 12,13,14 are then closed from the condition of FIG. 2 to the condition of FIG. 1. Where less than the full number of fletching is being replaced, fletching guides corresponding to fletching still attached to the shaft 20 are simply closed down so that the grooves 26 pass over the fletching still attached. Collar 18 is emplaced to hold fletching guides 12,13,14 in closed position. When the glue or adhesive is dry, or at least initially set, collar 18 is withdrawn, and the arrow shaft 20 with fletching 22 is withdrawn, with or without splaying of fletching guides 12,13,14.

If it is desired to perform the foregoing procedure without engaging nock 21, C-shaped wire ring 19 may be pivoted out of the way about ends 24.

It may be seen that the invention is simple, and easily mass-producible, so that an archer may afford to stock several said tools for simultaneous making or repair of several arrows.

If the head of the arrow (not shown) is larger than collar 18, the completed arrow may be withdrawn from collar 18 by flexing fletching 22 and drawing same through the collar.

Those skilled in the art will readily derive other embodiments of the invention drawn from the teachings herein. To the extent that such alternative embodiments are so drawn, it is intended that they shall fall within the ambit of protection provided by the claims appended hereto.

Having described my invention in the foregoing specification and the accompanying drawings in such a clear and concise manner that those skilled in the art may readily understand and easily practice the invention, that which I claim is:

1. A fletching tool for precise alignment and adhesion facilitation of pre-molded fletching to an arrow shaft, said arrow shaft defining a fletching-attachment locus, said fletching tool comprising:

spool means for locating said fletching tool upon said arrow shaft in precise spatial relationship to said fletching-attachment locus, said spool means having a bore concentric said arrow shaft;

a plurality of fletching guides coupled to said spool means, each one of said plurality of fletching guides comprising a sector of a cylindrical annulus, the number of said fletching guides equal to the number of said pre-molded fletching borne in finished form by said arrow shaft, the totality of said plurality of fletching guides cooperatively comprising in closed position a torsionally rigid cylindrical annulus circumscribing said fletching-attachment locus, each one of said plurality of fletching guides having longitudinal groove means for initial fletching retention and for precise location in said closed position of said fletching against said fletching-attachment locus;

splaying means for outwardly splaying each said one of said plurality of fletching guides from said spool means in an open position, said open position for easy insertion of said fletching into said longitudinal groove means and for easy removal of said fletching tool from said arrow shaft when said fletching adheres to said fletching-attachment locus; and collar means detachably coupled to said plurality of fletching guides for temporarily retaining said fletching guides in said closed position.

2. A fletching tool according to claim 1 wherein said splaying means comprises hinge means coupled between each said one of said plurality of fletching guides and said spool means.

3. A fletching tool according to claim 1 wherein said collar means comprises slideable ring means concentric said plurality of fletching guides for compressing said plurality of fletching guides against said fletching-attachment locus in said closed position, said slideable ring means detachable from said plurality of fletching guides for releasing said fletching guides into said open position.

4. A fletching tool according to claim 1 wherein said collar means comprises threaded cap means concentric said plurality of fletching guides for compressing said plurality of fletching guides against said fletching-attachment locus in said closed position, said threaded cap means detachable from said plurality of fletching guides for releasing said fletching guides into said open position, said threaded cap means having hole means concentric said arrow shaft and internal threading, said plurality of fletching guides having external threading cooperative in closed position with said internal threading.

5. A fletching tool according to claim 1 further comprising adhesion-resistance means for resisting adhesion of said plurality of fletching guides to any of said fletching, said arrow shaft and adhesive material applied to said arrow shaft and said fletching.

6. A fletching tool according to claim 5 wherein said adhesion-resistance means comprises a coating of adhesion-resistant material upon each of said fletching guides adjacent said fletching.

7. A fletching tool according to claim 1 wherein each said longitudinal groove means defines a portion of a helix about said arrow shaft, for precise alignment of spiral fletching.

8. A fletching tool according to claim 1 wherein said arrow shaft has a nock, said fletching tool further comprising nock retainer means coupled to said spool means for longitudinally defining the relative location of said fletching tool, said fletching-attachment locus, and said nock.

9. A fletching tool according to claim 8 wherein said nock retainer means comprises a C-shaped wire ring, the ends of said C-shaped wire ring captive to said spool means transverse said plurality of fletching guides, the wire thickness of said C-shaped wire ring snugly cooperative within said nock adjacent the longitudinal center line of said arrow shaft.

10. A fletching tool according to claim 9 further comprising means for pivoting said C-shaped wire ring away from interference with said arrow shaft when engagement with said nock is not desired.

11. A fletching tool for precise alignment and adhesion facilitation of pre-molded fletching to an arrow shaft, said arrow shaft defining a fletching-attachment locus, said fletching tool comprising:

spool means for locating said fletching tool upon said arrow shaft in precise spatial relationship to said fletching-attachment locus, said spool means having a bore concentric said arrow shaft;

a plurality of fletching guides coupled at a first end to said spool means, each one of said plurality of fletching guides comprising a sector of a cylindrical annulus, the number of said fletching guides equal to the number of said pre-molded fletching borne in finished form by said arrow shaft, the totality of said plurality of fletching guides coopertively comprising in closed position a torsionally rigid cylindrical annulus circumscribing said fletching-attachment locus, each one of said plurality of fletching guides having longitudinal groove means for initial fletching retention and for precise location in said closed position of said fletching against said fletching-attachment locus;

splaying means adjacent said first end of each said one of said plurality of fletching guides for outwardly splaying each said one of said plurality of fletching guides from said spool means in an open position and for pressing each said fletching guide adjacent said first end against said arrow shaft in said closed position, said open position for easy insertion of said fletching into said longitudinal groove means and for easy removal of said fletching tool from said arrow shaft when said fletching adheres to said fletching-attachment locus; and collar means detachably coupled to said plurality of fletching guides for temporarily retaining said fletching guides in said closed position and for pressing a second end transverse said first end of each said one of said plurality of fletching guides against said arrow shaft.

* * * * *